United States Patent [19]

Djordjevic

[11] Patent Number: 4,662,825

[45] Date of Patent: May 5, 1987

[54] HYDRAULIC PUMP

[75] Inventor: Ilija Djordjevic, Windsor, Conn.

[73] Assignee: Stanadyne, Inc., Windsor, Conn.

[21] Appl. No.: 762,264

[22] Filed: Aug. 5, 1985

[51] Int. Cl.[4] ..... F04B 23/10; F04B 1/06; F04B 49/02; F02M 37/04

[52] U.S. Cl. ..... 417/206; 417/273; 417/295; 417/302; 417/307; 123/506

[58] Field of Search ..... 417/206, 273, 295, 302, 417/307, 309, 486–488, 440, 441; 91/491; 123/506

[56] References Cited

U.S. PATENT DOCUMENTS

| | | | |
|---|---|---|---|
| 2,461,121 | 2/1949 | Markham | 417/273 |
| 2,653,543 | 9/1953 | Mott | 417/206 |
| 2,805,038 | 9/1957 | Towler et al. | 417/307 |
| 3,412,682 | 11/1968 | Kemp | 417/206 |
| 4,474,158 | 10/1984 | Mowbray | 123/506 |

FOREIGN PATENT DOCUMENTS 934453 10/1955 Fed. Rep. of Germany ..... 417/462

*Primary Examiner*—John J. Vrablik

*Attorney, Agent, or Firm*—Chilton, Alix & Van Kirk

[57] ABSTRACT

A supply pump for continuously supplying pressurized fuel to an accumulator-type injector system employs an electrically controlled metering valve for regulating the supply of fuel to the pump chamber. The output pressure of the pressurized fuel from the pump is regulated by means of a relief valve assembly. The inlet metering valve also controls the operation of the relief valve assembly. The relief valve assembly comprises a hydraulically controlled piston which selectively controls the position of a valve member for releasing pressurized fuel from the outlet portion of the pump so that the pressurized fuel in the injection system may be regulated by controlling the fuel supply to the pump chamber and by also releasing pressurized fuel from the pressurized injection system.

16 Claims, 9 Drawing Figures

HYDRAULIC PUMP

BACKGROUND AND BRIEF SUMMARY OF THE INVENTION

The present invention relates generally to pumps adapted to pressurize fluids for hydraulic systems working with high pressure fluids. More particularly, the present invention relates to a supply pump which is adapted for incorporation into an accumulator-type fuel injection system.

In accumulator injector fuel injection systems such as disclosed in U.S. Pat. No. 4,566,416 entitled "ACCUMULATOR NOZZLE FUEL INJECTION SYSTEM" and assigned to the assignee of the present invention, a diesel engine drives a fuel pump which supplies fuel under a pressure to a fuel supply chamber. The pressurized fuel in the supply chamber is supplied to the fuel injectors of the engine for injection into the engine combustion chambers. Each of the accumulator injectors includes an accumulator chamber and a control chamber. Pressurized fuel in the control chamber is released for momentarily injecting a charge of fuel from the accumulator chamber. The fuel supply pump is continuously operated by the engine to supply fuel under pressure to the fuel supply chamber so that the fuel pressure within each injector may be restored to the supply pressure between fuel injection events.

It is accordingly a principal aim of the present invention to provide a new and improved fuel supply pump for continuously supplying fuel under a pressure to a storage chamber for delivery to the accumulator injectors of the associated engine. Included within the general aims of the present invention is the provision of a fuel supply pump of efficient construction which supplies a regulated pressure which is very responsive to changes in speed and fuel requirements of the associated engine.

Briefly stated, the invention in a preferred form is a fuel supply pump which comprises a housing enclosing a stator which forms a pump chamber, an axial supply bore connecting the pump chamber and a plurality of plunger bores opening into the pump chamber. A vane-type transfer pump is employed to transfer fuel from a fuel inlet through a supply passage to the pump chamber. A pressure regulator in communication with the supply passage acts to provide a substantially constant pressure to the fuel delivered to the pump chamber. A pump plunger is cooperatively reciprocable in each of the plunger bores to pressurize the fuel received in the pump chamber. An actuator ring which comprises a plurality of roller members mounted in fixed position is rotatable about the plungers to sequentially displace the plungers for reciprocation in the plunger bores. A rotor is rotatably received in the housing and adapted for being driven by the associated engine to rotate the actuator ring. An inlet metering valve is employed to meter the fuel supplied to the pump chamber. Pressurized fuel from the pump chamber is received by a fuel output bore for delivery to the injection system of the associated engine. A relief valve assembly comprises a relief chamber and a hydraulically controlled piston which is displaceable in the chamber to control the pressure of the fuel in the fuel output bore by selectively releasing fuel from the output bore.

In a preferred form of the invention, the inlet metering valve is a selectively positionable spool valve which is interposed in the supply passage. A solenoid or a stepper motor is employed to control the axial position of the metering valve. The opening pressure of the relief valve is also hydraulically controlled in response to the position of the metering valve.

DETAILED DESCRIPTION OF THE INVENTION

Figure 1:
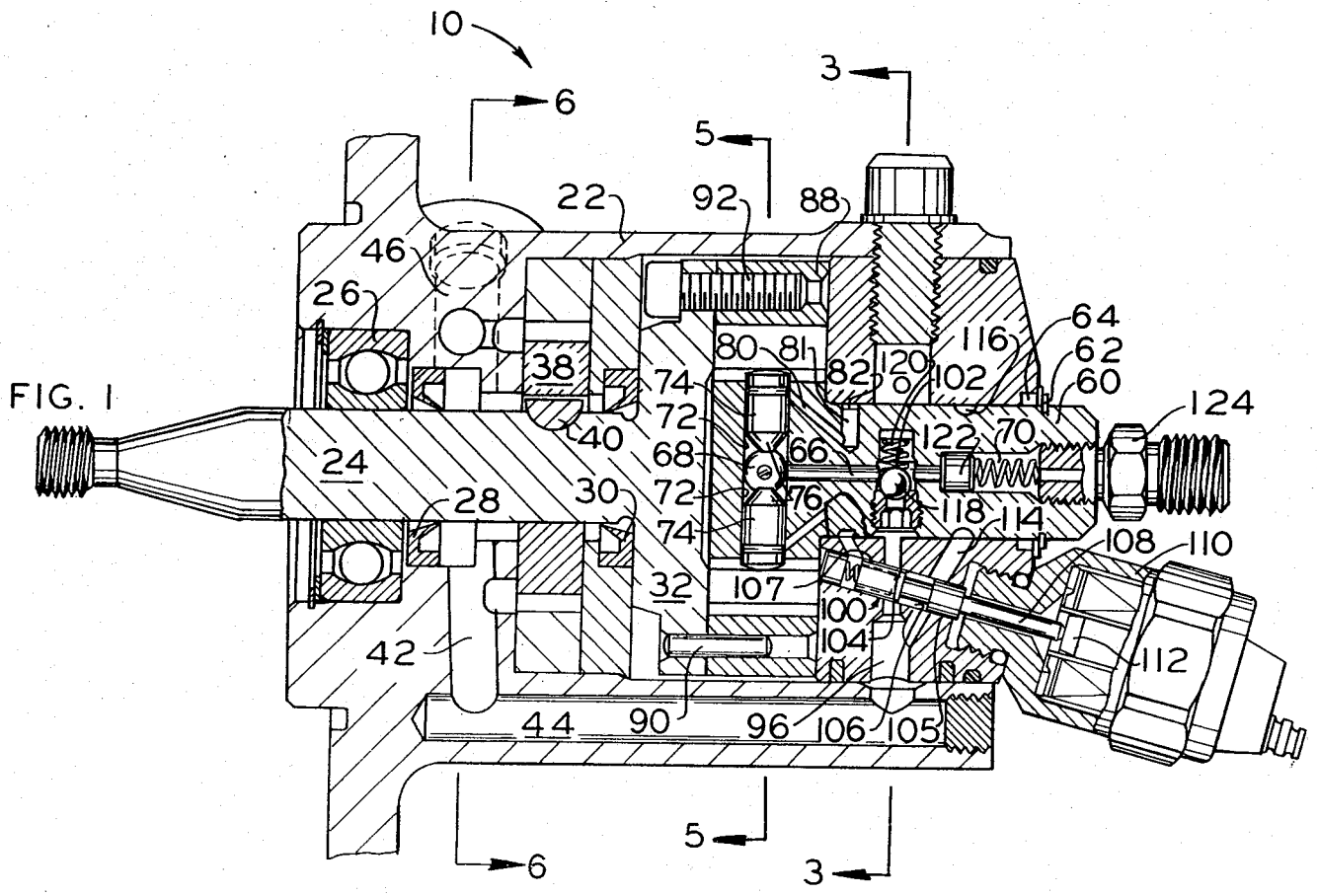
FIG. 1 is a side sectional view, partly in section, partly in phantom and partly broken away, of a fuel supply pump in accordance with the present invention.

With reference to the drawing wherein like numerals represent like parts throughout the several FIGURES, a fuel supply pump in accordance with the present invention is generally designated by the numeral 10. Fuel supply pump 10 is an inlet metered, pressure regulated pump which is adapted for receiving fuel from a fuel reservoir (not illustrated) and pressurizing the fuel for delivery to injectors of a fuel injection system of an associated internal combustion engine (not illustrated). The fuel supply pump of the present invention is particularly adaptable for use in an accumulator-type fuel injection system such as disclosed in U.S. Pat. No. 4,566,416 entitled "ACCUMULATOR NOZZLE FUEL INJECTION SYSTEM" which application is assigned to the assignee of the present invention.

Figure 2:
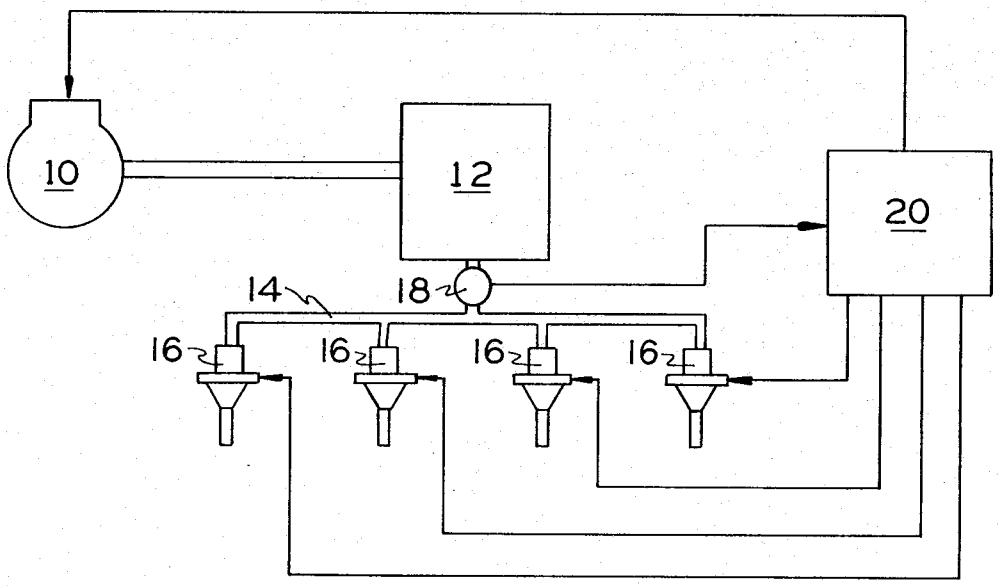
FIG. 2 is a schematic view illustrating a fuel injection system incorporating the fuel supply pump of FIG. 1.

With reference to FIG. 2, the fuel supply pump 10 is adapted for delivering essentially a continuous supply of high pressure fuel to an equalizer chamber designated generally by the numeral 12. Equalizer chamber 12 accumulates the pressurized fuel. The volume of equalizer chamber 12 depends on the application. The accumulated pressurized fuel is supplied via a rail 14 to a plurality of accumulator injectors 16 for injection into the combustion space of an internal combustion engine. The accumulator injectors may assume a variety of forms—none of which are the specific subject of the present invention. Exemplary accumulator injectors which are suitable in an injection system to which the fuel supply pump is particularly adapted may be of a type such as disclosed in U.S. Pat. No. 4,566,416 entitled "ACCUMULATOR NOZZLE FUEL INJECTION SYSTEM" and U.S. application Ser. No. 715,354 filed Mar. 25, 1985 entitled "MODULAR ACCUMULA- TOR INJECTOR", which patent applications are assigned to the assignee of the present invention.

A pressure sensor 18 is interposed in the rail 14 for sensing the pressure of the accumulated fuel. Electrical signals indicative of the injection system pressure are communicated to an electronic control unit 20. The electronic control unit transmits electrical signals to the fuel supply pump 10 for regulating the pressure of the fuel supplied by the pump in accordance with various operational parameters. The regulation of the pressure of the supplied pressurized fuel output will be described in detail below. Electronic control unit 20 also transmits electrical signals to each of the accumulator injectors for actuating the injectors for coordinated sequential injection of pressurized fuel into the internal combustion engine.

With reference to FIG. 1, fuel supply pump 10 comprises a housing 22 which generally encloses and/or mounts the various components and sub-assemblies of the fuel supply pump. A shaft of a rotor 24 extends axially through a central axis of the housing and is received by the housing for rotatable motion about its axis with the forward end protruding from the housing. The shaft of rotor 24 is adapted at the forward end for being rotatably driven by an associated internal combustion engine. The shaft may also be driven independently from the engine by an electric motor. Rotor 24 functions as the drive connection for mechanically powering the fuel supply pump. The shaft of the rotor is interiorly rotatably mounted by means of a bearing assembly 26. The shaft of the rotor is also sealed in fluid tight relationship within the housing by means of a pair of axially spaced bi-annular sealing elements 28 and 30. The inner end of the rotor radially flares to form an integral coupling plate 32 which is rotatable in an enlarged cavity formed in the housing.

Figure 6:
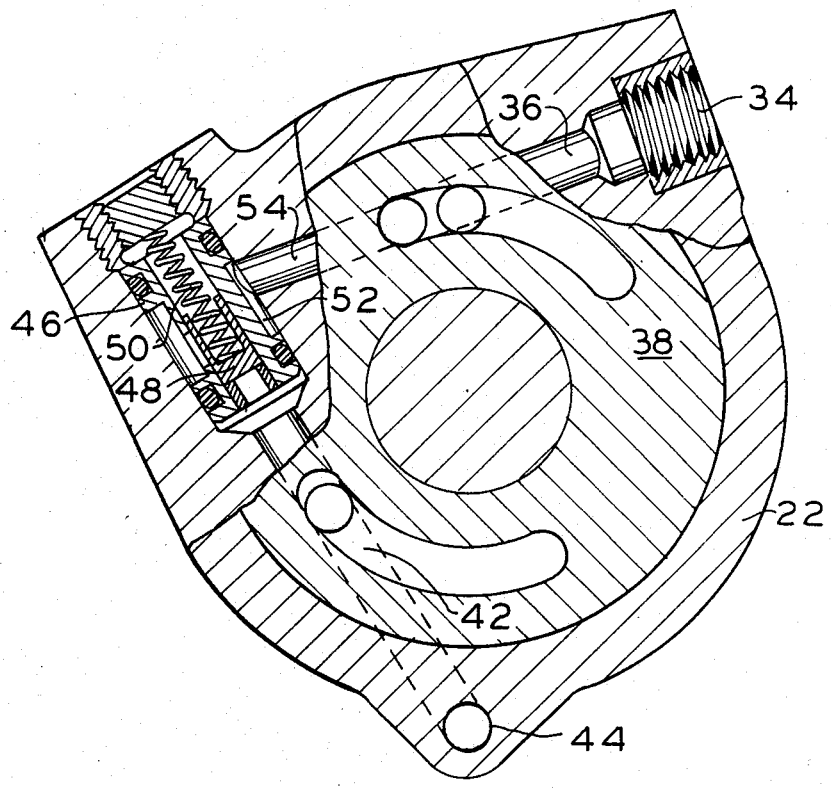
FIG. 6 is a sectional view, partly in section and partly broken away, of the fuel supply pump of FIG. 1 taken along the line 6—6.

With additional reference to FIG. 6, a fuel inlet 34 opening through the housing interiorly leads to an inlet passage 36 formed in the housing. Inlet passage 36 leads to a vane-type transfer pump 38. A key 40 rotatably couples the transfer pump with the rotor 24. Transfer pump 38 is an eccentric positive displacement pump which is driven by the rotor for supplying (in cooperation with a pressure regulator) a substantially constant transfer pressure to the fuel from the fuel inlet 34. Fuel exiting the transfer pump 38 enters a passage 42 extending obliquely to the rotor rotational axis at an intermediate location of the passage. One end of passage 42 communicates with an axially extending supply bore 44 formed in the housing. The other end of passage 42 leads to a pressure regulator 46. As best illustrated in FIG. 6, pressure regulator 46 includes a release piston 48 which is biased by a spring 50 having an adjustable bias force for providing selective fluid communication via a spill annulus 52 and a return conduit 54 to the transfer pump when the pressure of the fuel in passage 42 exceeds a preestablished threshold level. Thus, the pressure regulator 46 provides a means for regulating the output transfer pressure for the fuel exiting the transfer pump so that the transfer pressure is proportional to the speed of the rotor and consequently the speed of the associated engine.

A stator 60 having a concentric stepped sleeve-like form 60 axially aligns with rotor 24 and is mounted in a rigid fixed position at the output end of the housing. A lock ring 62 secures the stator in position and an adjacent O-ring 64 seals the stator in fluid tight relationship with the end portion of the housing. An axial supply bore 66 formed in the stator connects at a forward end with an interiorly formed pump chamber 68 and at the other end with an enlarged concentric axially extending output bore 70. Four equiangularly spaced radial bores 72 extend outwardly from pump chamber 68 through the periphery of the enlarged portion of the stator.

Figure 5:
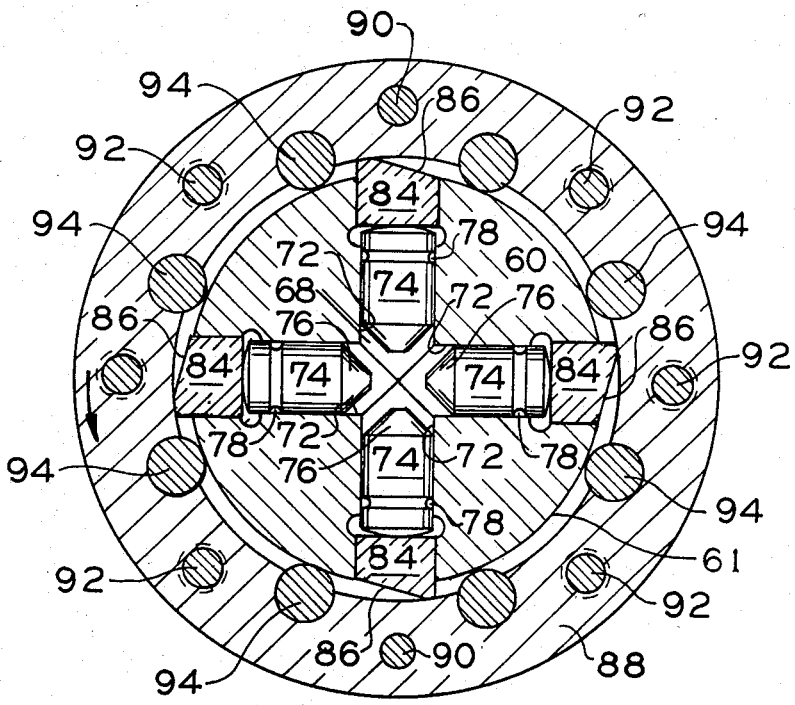
FIG. 5 is a sectional view of the fuel supply pump of FIG. 1 taken along the line 5—5.

With additional reference to FIG. 5, a pump plunger 74 is received in each radial bore 72 for axial reciprocation therein to pressurize fuel received in pump chamber 68. Each pump plunger 74 has a tapered tip 76 which may extend into the pump chamber at an inward axial displacement position in the radial bore. Plunger 74 exteriorly forms a circumferentially.extending leak off annulus 78 with the radial bore for returning fuel which leaks past the plungers. The return of the fuel is necessary if the fuel viscosity is very low and lubricating oil dilution cannot be tolerated. The fuel is returned to the transfer pump via return passages 80, a plurality of bores 81 and a return annulus 82 circumferentially extending between the periphery of the stator and the housing. The outer end of each of the plungers is captured by a follower 84. A ramp-like engagement surface 86 is formed at the outer end of each of the followers 84.

A rotatable mounting ring 88 concentric with the forward head of stator 60 encircles the foregoing described plunger/follower assemblies. A pair of locating pins 90 precisely locates the mounting ring relative to the coupling plate 32 of the rotor. A plurality of bolts 92 securely couple the coupling plate to the mounting ring for rotation therewith. As best illustrated in FIG. 5, mounting ring 88 mounts a plurality of axially extending equi-angular spaced rollers 94. The peripheral cylindrical surface 61 formed by the forward head of the stator functions as a guide for the rollers. As the mounting ring rotates in the direction of the arrow, the rollers ride surface 61 and successively engage the engagement surfaces 86 of the followers to inwardly displace the plungers 74 in a synchronous cooperating fashion for pressurizing fuel in the pump chamber.

An inlet bore 96 leads from supply passage 44 via a metering valve 100 and an inlet check valve assembly 102 to the axial supply bore 66 for transfering fuel under a substantially constant transfer pressure to the pump chamber. Metering valve 100 comprises a spring biased spool valve 104 which is closely received in a bore which extends obliquely relative to both the central axis of the rotor and the inlet bore 96. Spool valve 104 has a pair of axially spaced land portions 105 and 107 which intermediately define a control annulus 106. A control pin 108 extends axially at one end of the spool valve.

An electrical solenoid 110 is threadably mounted to the housing. The solenoid is controlled by operational pulses transmitted from electronic control unit 20. The solenoid 110 includes an axially displaceable armature 112 which engages the end of the control pin 108 to control the axial position of spool valve 104. A control passage 114 extends from inlet bore 96 to communicate with a control annulus 116 which encircles sleeve 60. The spool valve is selectively axially displaceable to define three distinct operational conditions for the pump. In a first delivery position, fuel under a transfer pressure flows only through the inlet bore to the inlet check valve assembly via control annulus 106. The rate of flow through the inlet bore pump is governed by the variable restriction presented by the spool valve. In an intermediate axial or null position, lands 105 and 107 seal the inlet bore 96 to the passage of fuel while fuel flows via control annulus 106 through control passage 114. In a third no delivery or idle position, lands 105 and 107 seal inlet bore 96 and control passage 114, respectively, to the passage of fuel. The spool valve is axially displaced on the order of 0.020 inches between the null and idle positions.

Inlet check valve assembly 102 includes a threaded fitting forming a conical seat surrounding a central orifice. A ball 118 is biased by a spring 120 into a sealing engagement with the seat. Fuel under a transfer pressure is sufficient to overcome the bias of the spring to allow fuel flow from the inlet bore to the axial supply bore 66 and into the pump chamber 68. The flow of fuel into the pump chamber acts to force the plungers 74 radially outwardly until the rollers 94 engage the followers 84 and eventually force the plungers inwardly. The inward displacement of the plungers pressurizes the fuel and forces the fuel through the supply bore to the enlarged output bore 70. During the inward pressure stroke of the plungers, the pressure of the fuel in the pump chamber and supply passage maintains the inlet check valve assembly in the closed position under the bias of spring 120 to prevent a reverse flow of pressurized fuel through the inlet bore.

A spring biased delivery valve 122 engages the end of the output bore 70 to normally seal the end of the axial supply bore to maintain the pressure in output bore 70. During the pressure generating stroke of the plungers, the pressurized fuel displaces valve 122 to provide one-way fuel communication of the pressurized fuel into the output bore 70. A connector fitting 124 is threaded into the end of the sleeve for connecting the output bore with a delivery conduit which delivers the pressurized fuel to the equalizer chamber 12.

Figure 3:
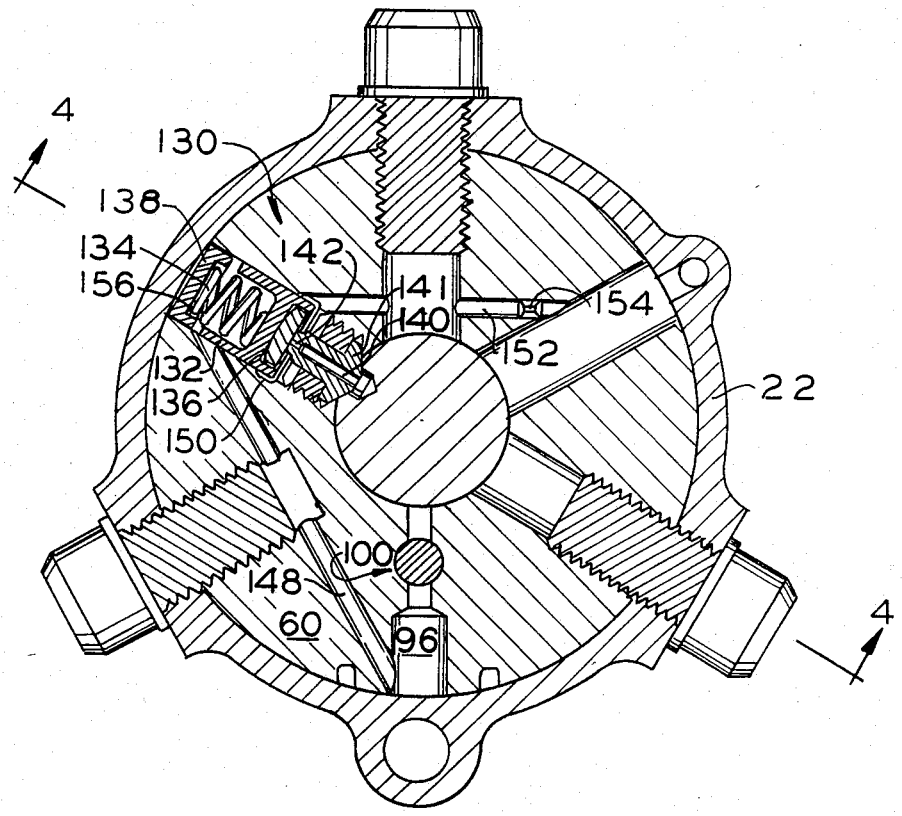
FIG. 3 is a sectional view of the fuel supply pump of FIG. 1 taken along the line 3—3.
Figure 4:
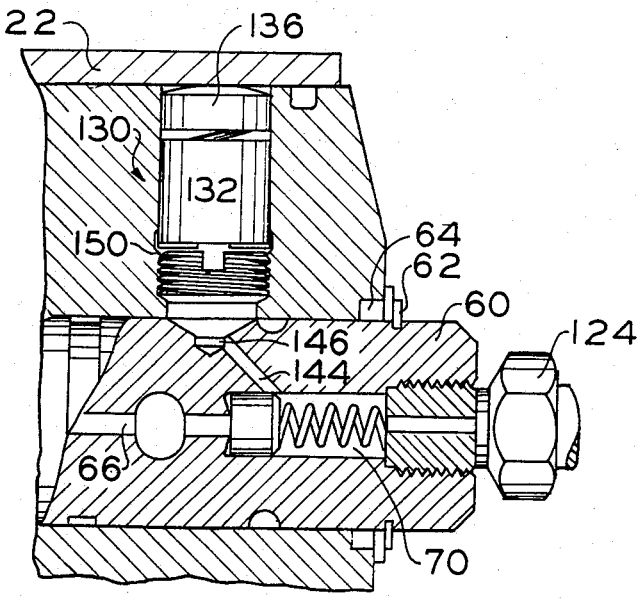
FIG. 4 is a fragmentary sectional view, partly in section and partly broken away, of the fuel supply pump of FIG. 3 taken along the line 4—4.
Figure 7:
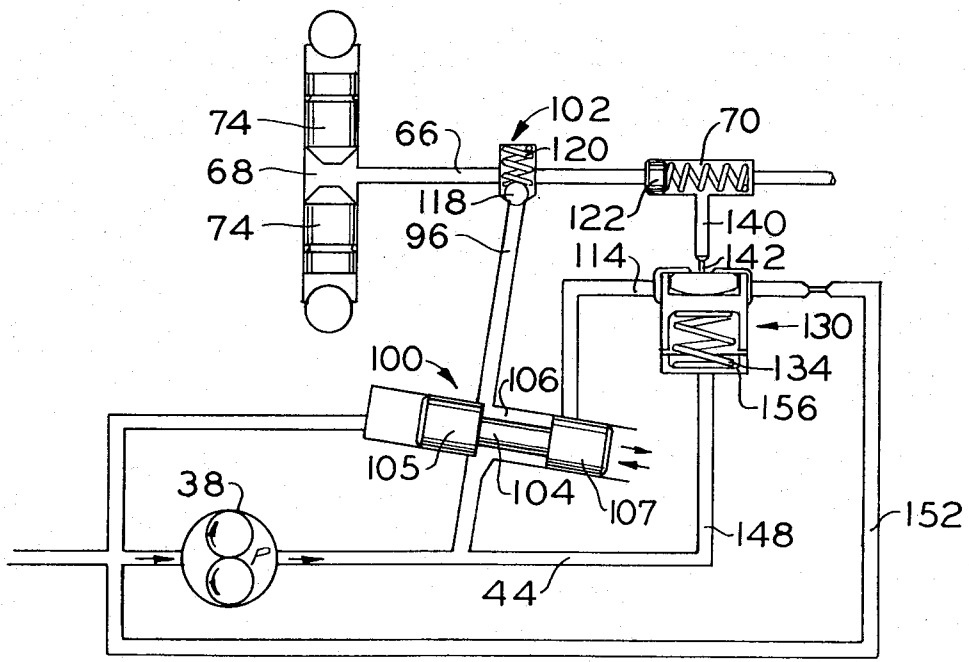
FIG. 7 is a schematic view of a portion of the fuel supply pump of FIG. 1 illustrating the operation of the inlet metering valve and relief valve assemblies thereof.

The output pressure of the fuel supplied by the fuel supply pump is hydraulically regulated by inlet metering valve 100 which controls a variable pressure relief valve assembly designated generally by the numeral 130. The relief valve assembly 130 relieves the system during no delivery periods as well as in response to load changes (high load to low load) in order to extend the injector solenoid control time. With reference to FIGS. 3, 4 and 7, relief valve assembly 130 is mounted in a radial bore of sleeve 60. Relief valve assembly 130 comprises a hydraulically actuated piston 132 which is displaceable in relief chamber 156. Piston has a quasi-H-shaped section forming a pair of retainers. One retainer captures a coil spring 134 and the other retainer captures a sealing element 136. A spring retainer cap 138 seats the other end of spring 134 and provides a radial stop which limits the movement of piston 132. A cylindrical T-shaped insert 141 forms a central bore 140 which terminates with a restricted release orifice 142. A relief passage 144 communicates via a relief recess 146 with bore 140 and release orifice 142. Spring 134 normally biases the piston 132 so that the sealing element 136 engages the end of the insert for sealing the release orifice 142. Sealing element 136 has a convex or tapered face opposite the sealing face to facilitate self-alignment of the element. An auxiliary supply passage 148 connects between inlet bore 96 and one end of the bore for supplying fuel under a transfer pressure to one side of piston 132. A supply chamber 150 at the other end of the bore communicates with control passage 114. A second return passage 152 also communicates with supply chamber 150. A restricted orifice 154 is interposed in return passage 152. Return passage 152 connects with the fuel return path of the pump. Pressure in the return path is lower than the transfer pressure as long as the seal land 105 closes control passage 114.

With reference to the schematic illustration of FIG. 7, when the inlet metering valve is in the illustrated delivery position, fuel at a constant transfer pressure flows through the inlet bore 96 via control annulus 106. Land 107 seals control passage 114 so that pressure in the supply chamber 150 is effectively vented to the low source of pressure in the return path of the pump via return passage 152. The relatively higher pressure of fuel in the relief chamber 156 plus the bias force of spring 134 forces the piston 132 so that captured seal element 136 seals release orifice 142 to thereby prevent the release of pressurized fuel from the output bore 70. When the solenoid is energized to displace the spool valve to the position (generally to the right in FIG. 7) wherein fuel at transfer pressure flows through control passage 114 via control annulus 106, the opposing hydraulic pressures exerted against piston 132 are substantially equalized so that the relatively higher pressure in bore 140 and at orifice 142 exceeds the biasing force of spring 134 to release pressure from the delivery bore via relief passage 152 to thereby regulate the pressure of the fuel in the output bore 70. Thus, the pressure in the injection system rapidly decreases to a preestablished value. In a preferred form, the fuel supply pump is configured so that the pressure delivered by the pump ranges from a maximum of 1,000 bars at maximum speed to a minimum of 400 bars at idle speed. By both interrupting the fuel supply to the pump chamber and simultaneously trimming the pressure from the injection system, a very responsive injection system is obtained. The metering valve 100 thus functions to control the opening pressure of seal element 136 and to meter the fuel supply to the pump chamber.

Figure 8:
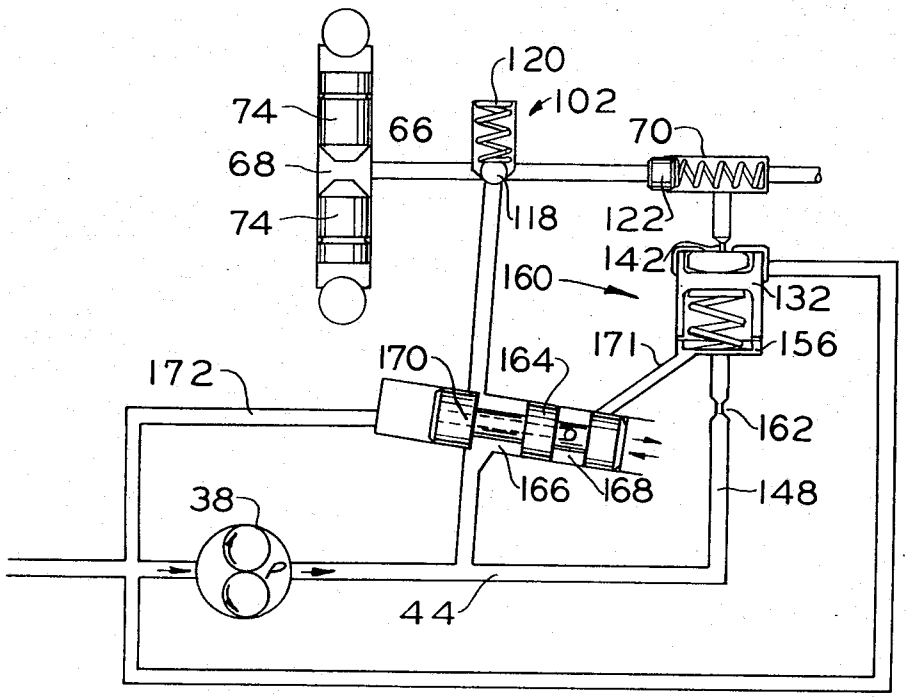
FIG. 8 is a schematic view of an alternate embodiment of a fuel supply pump in accordance with the present invention illustrating the operation of the inlet metering valve and relief valve assemblies thereof.

With reference to FIG. 8, an alternative relief valve assembly embodiment is generally designated by the numeral 160. Relief chamber 156 communicates via a restricted orifice 162 with auxiliary supply bore 148. The inlet metering valve comprises a spool valve 164 which forms a pair of axially spaced annuli 166 and 168. An axial bore 170 opens through one end of the spool valve and communicates via a radial passage with annulus 168. A control bore 171 selectively connects annulus 168 and relief chamber 156 so that in a no-delivery state, the spool valve 164 is displaced to close the supply of fuel through the inlet bore to the pump chamber and also provide fluid communication between relief chamber 156 and the return path 172 of the injection pump. Thus, the opposing hydraulic forces exerted against piston 132 are substantially equalized so that pressurized fuel may be released from the delivery bore through discharge orifice 142 to the return passage of the fuel supply pump. The injection pressure in the injection system is sufficient to overcome the pressure of the relief valve which is kept closed only by the spring force in the latter described state. The hammer effect resulting from the fuel being abruptly prevented from entering the pump chamber does not prevent the relief valve from opening. In a no delivery phase of pump operation injection pressure of the injection system may be rapidly decreased such as may be desirable when the engine changes from a maximum speed to an idle speed. At high pressure control of a small quantity requires a very short operating time for the injector solenoid.

Figure 9:
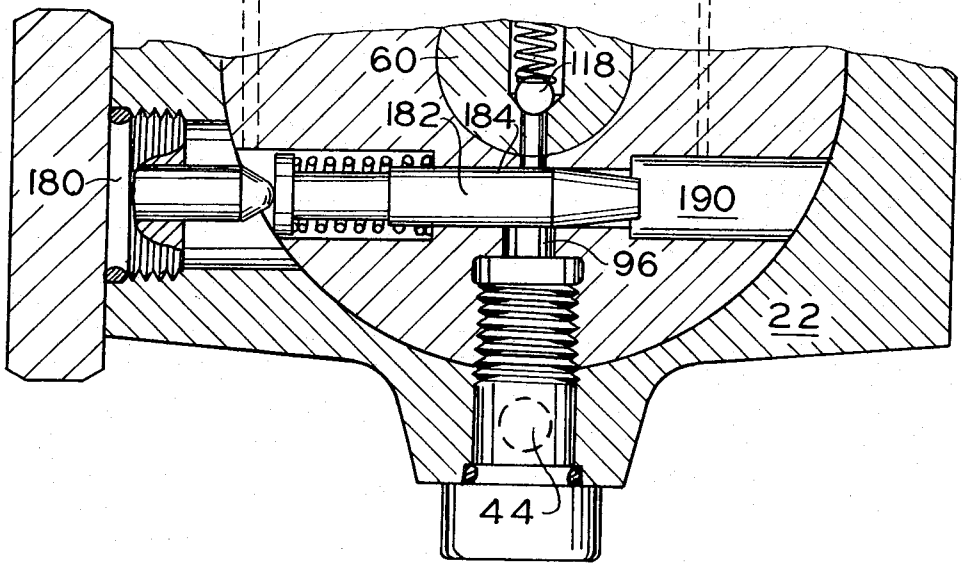
FIG. 9 is a fragmentary end sectional view, partly in section and partly broken away, of an alternate embodiment of the fuel supply pump of the present invention.

It should be appreciated that the operation of the foregoing fuel supply pump is controlled by the operating pulses transmitted to the solenoid 110. The solenoid controls the inlet metering valve to both actuate the relief valve for regulating the output pressure of the pressurized fuel and also to control the supply of fuel to the pump. With reference to FIG. 9, an alternate embodiment of the fuel supply pump employs a stepper motor 180 to control a hydraulically balanced inlet metering valve 182. The stepper motor 180 and valve 182 are disposed generally transversely to the rotational axis of the pump. Metering valve 182 includes a land 184 which axially extends so that in one axial position of the valve, the land 184 seals to prevent the passage of fuel through both the inlet bore 96 and a control passage 190. In the illustrated position, land 184 seals the inlet bore but allows fluid communication through the control passage. The tapered tip portion of the metering valve in a third position allows fuel communication at transfer pressure through both the inlet bore 96 to the pump chamber 68 and the control passage 190 to a relief chamber. The relief valve assembly (not illustrated) is preferably configured to effect a release of pressure from the output bore 70 in the event that inlet valve 182 is positioned to prevent the passage of fuel to the control passage. Metering valve 182 is spring-biased for engagement with the actuating pin of the stepper motor.

In operation, the fuel supply pump 10 is driven by the associated engine so that rotation of the rotor drives the transfer pump 38 and reciprocates the pump plungers 74. The transfer pump supplies fuel at a relatively low constant supply pressure to the pump chamber 68 for pressurization thereof. The pressurized fuel is forced to the outlet bore 70 for delivery to the injection system in a generally continuous fashion. The pressure of the pressurized fuel in the injection system is controlled by the operating pulses transmitted by the electronic control unit 20 to the solenoid 110 or a stepper motor for controlling the inlet metering valve 100. The inlet metering valve controls both the supply of fuel to the pump chamber and the relief valve assembly for adapting pressure in the injection system to the actual requirements. It should be appreciated that the foregoing pump has a very small dead volume and very low parasitic energy consumption characteristics. There are few high pressure sealing points. The pump is also adaptable for use with a liquid having poor lubricating qualities such as methanol, alcohol and gasoline since a lubricating system may be provided which is separate from the supply and pump system. The pump cavity may be filled with engine oil for lubricating purposes. It will also be appreciated that the foregoing pump cannot seize.

While a preferred embodiment of the foregoing fuel injection pump has been set forth for purposes of illustration, the foregoing description should not be deemed a limitation of the invention herein. Accordingly, various modifications, adaptations and alternatives may occur to one skilled in the art without departing from the spirit and scope of the present invention.

What is claimed is:

1. A hydraulic pump for pressurizing fluid comprising:

a housing;

stator means mounted in said housing in fixed position therewith to form a pump chamber, a delivery passage connecting said pump chamber and at least one plunger bore opening into said pump chamber;

supply means including an inlet and a supply passage to transfer fluid from said inlet through said supply passage to said pump chamber;

pump plunger means reciprocable in said at least one plunger bore to pressurize fluid in said pump chamber;

rotor means rotatable in said housing to reciprocate said plunger means;

output receiver means to receive pressurized fluid from said delivery passage;

relief valve means comprising a variable pressure relief valve and a valve control passage to control the pressure in said output receiver means by selectively releasing fluid therefrom; and inlet metering means comprising a metering valve interposed in said supply passage and selectively positionable to meter the fluid supplied to said pump chamber and to control the operation of said relief valve means by selectively controlling the pressure in said control passage to thereby control the opening pressure of said relief valve wherein the metering valve is positionable to simultaneously decrease the fluid supplied to the pump chamber and to decrease the opening pressure of the release valve.

2. The hydraulic pump of claim 1 wherein said metering valve comprises an axially displacable spool valve.

3. The hydraulic pump of claim 1 further comprising an electrically operated control means to control the position of said metering valve.

4. The hydraulic pump of claim 1 wherein said relief valve means comprises a hydraulically controlled piston.

5. The hydraulic pump of claim 4 wherein said relief valve means further comprises a relief passage leading from said output receiver means and a valve member controlled by said piston to selectively open and close said relief passage to the release of pressurized fluid therefrom.

6. The hydraulic pump of claim 5 wherein said metering valve is displaceable between a plurality of operative positions and when said metering valve is in one said position, the passage of fluid from said supply passage to said pump chamber is terminated and hydraulic pressure is applied to said piston to selectively open said relief passage.

7. The hydraulic pump of claim 1 wherein said supply passage includes a supply bore leading to said pump chamber and further comprising a check valve to control the flow of fluid into said supply bore.

8. The hydraulic pump of claim 1 further comprising a check valve to control the flow of fluid between said delivery passage and said output receiver means.

9. The hydraulic pump of claim 1 wherein said stator means forms a cylindrical guide surface, said rotor means includes a plurality of angularly spaced rollers, and said plunger means comprises a plunger and an associated follower for each plunger bore, and said rollers ride along said guide surface and engage a follower to reciprocate a plunger.

10. A supply pump for pressuring fuel for delivery to a fuel injection system of an associated internal combustion engine comprising;

a housing;

stator means mounted in said housing in fixed position therewith to form a pump chamber, a delivery passage connecting said pump chamber and at least one plunger bore opening into said pump chamber;

fuel supply means including a fuel inlet, a supply passage and a transfer pump to transfer fuel from said fuel inlet through said supply passage to said pump chamber;

pump plunger means reciprocable in said at least one plunger bore to pressurize fuel in said pump chamber;

rotor means including an actuator means rotatable to actuate said plunger means to sequentially reciprocate said plunger means, said rotor means adapted for being driven by said associated engine;

fuel outlet means to receive pressurized fuel from said pump chamber for delivery to the injection system of said associated engine;

relief valve means comprising a variable pressure relief valve and a valve control passage to control the pressure in said fuel output means by selectively releasing fuel therefrom; and inlet metering means comprising a metering valve interposed in said supply passage and selectively positionable to meter the fuel supplied to said pump chamber and to control the operation of said relief valve means by selectively controlling the pressure in said control passage to thereby control the opening pressure of said relief valve wherein the metering valve is positionable to simultaneously decrease the fluid supplied to the pump chamber and to decrease the opening pressure of the release valve.

11. The supply pump of claim 10 wherein said relief valve means comprises a relief chamber, a relief passage connecting said relief chamber and said fuel output means, a hydraulically controlled piston disposed in said relief chamber, and a valve member controlled by said piston to selectively open said relief passage to permit the release of pressurized fuel from said fuel output means.

12. The supply pump of claim 11 wherein said control passage communicates with said relief chamber, said metering valve being positionable to selectively open and close said control passage.

13. The supply pump of claim 10 wherein said metering valve is axially displaceable to variably meter fuel and control the operation of the relief valve means.

14. The supply pump of claim 10 wherein said plunger means comprises a plunger and an associated follower for each plunger bore and said actuator means comprises an assembly of angularly spaced rollers rotatable about said plunger means and engageable with a follower to reciprocate a plunger.

15. The supply pump of claim 11 wherein said relief chamber communicates with a return passage for returning low pressure fuel to the transfer pump.

16. The supply pump of claim 10 wherein the metering valve is axially displaceable to a first position wherein fuel is supplied to said pump chamber, a second position wherein the supply of fuel to said pump chamber is terminated, and a third position wherein the supply of fuel to said pump chamber is terminated and pressurized fuel is controllably released from said fuel output means.

* * * * *

UNITED STATES PATENT AND TRADEMARK OFFICE

CERTIFICATE OF CORRECTION

PATENT NO. : 4,662,825

DATED : May 5, 1987

INVENTOR(S) : Ilija Djordjeciv

It is certified that error appears in the above-identified patent and that said Letters Patent is hereby corrected as shown below:

In column 9, line 10, "outlet" should be --output--.

Signed and Sealed this

Twenty-fourth Day of November, 1987

*Attest:*

DONALD J. QUIGG

*Attesting Officer*

*Commissioner of Patents and Trademarks*